United States Patent [19]

Kinigakis et al.

[11] Patent Number: 5,039,001

[45] Date of Patent: Aug. 13, 1991

[54] MICROWAVABLE PACKAGE AND PROCESS

[75] Inventors: Panagiotis Kinigakis, West Windsor, N.J.; Terry L. Taylor, Pound Ridge; John S. Witzeman, Stony Point, both of N.Y.

[73] Assignee: Kraft General Foods, Inc., Glenview, Ill.

[21] Appl. No.: 539,683

[22] Filed: Jun. 18, 1990

[51] Int. Cl.[5] ..... B65D 51/16

[52] U.S. Cl. ..... 229/120; 220/359; 229/125.35; 426/118

[58] Field of Search ..... 229/120, 123.1, 125.35, 229/DIG. 14; 220/359; 206/484; 426/118, 521; 219/10.55 E, 10.55 M

[56] References Cited

U.S. PATENT DOCUMENTS

| | | | |
|---|---|---|---|
| 2,633,284 | 3/1953 | Moffett et al. | 426/118 |
| 3,863,832 | 2/1975 | Gordon et al. | 229/30 |
| 3,865,302 | 2/1975 | Kane | 229/43 |
| 3,937,396 | 2/1976 | Schneider | 426/118 |
| 3,997,677 | 12/1976 | Hirsch et al. | 426/113 |
| 4,013,798 | 3/1977 | Goltsos | 229/DIG. 14 |
| 4,210,674 | 7/1980 | Mitchell | 426/107 |
| 4,261,504 | 4/1981 | Cowan | 229/43 |
| 4,367,312 | 1/1983 | Bontinck et al. | 525/93 |
| 4,425,368 | 1/1984 | Watkins | 229/DIG. 14 |
| 4,469,258 | 9/1984 | Wright et al. | 229/123.1 |
| 4,537,305 | 8/1985 | Takanashi | 206/484 |
| 4,771,935 | 9/1988 | Hekal | 229/123.1 |
| 4,785,937 | 11/1988 | Tanezawa et al. | 206/484 |

*Primary Examiner*—Gary E. Elkins
*Attorney, Agent, or Firm*—Thomas R. Savoie

[57] ABSTRACT

The present invention provides packaging capable of room-temperature storage of foods followed by simplified microwave heating. The package also permits heating in conventional ovens. The package includes a multi-ply container portion having a central recess surrounded by a sealing rim to which is heat sealed a lid which is flexible and non-extensible and has good barrier proporties. The inner surface of the container is amorphous polyethylene terephthalate to assure good heat sealing. The out ply of the container is crystallizable to provide sufficient dimensional stability during heating. The package can be retorted and vents itself when microwave heated, thus simplifying storage and preparation of foods.

20 Claims, 1 Drawing Sheet

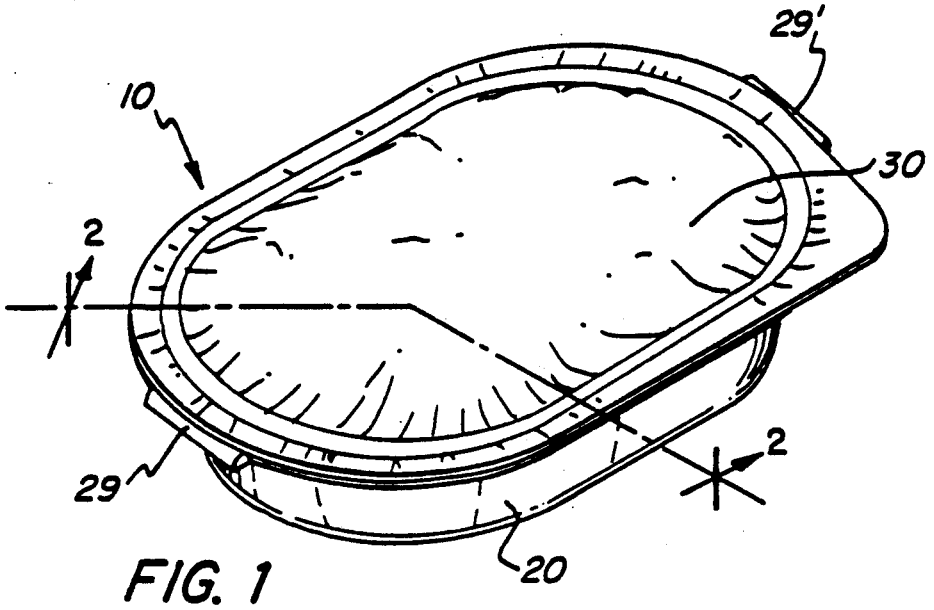
FIG. 1
FIG. 2
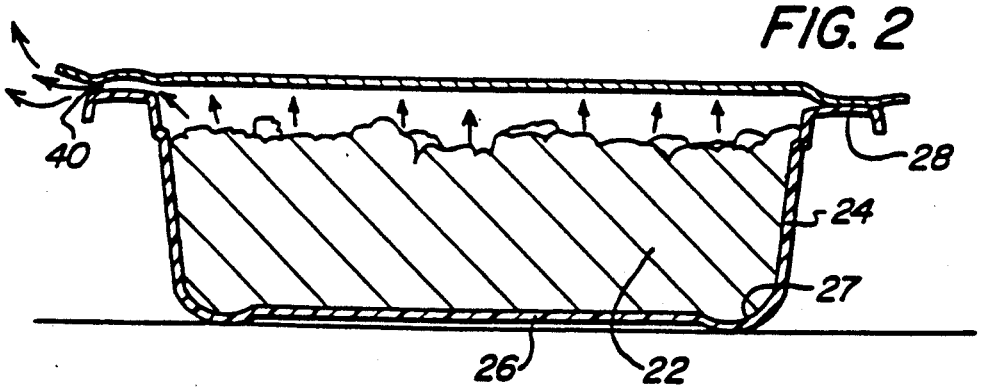
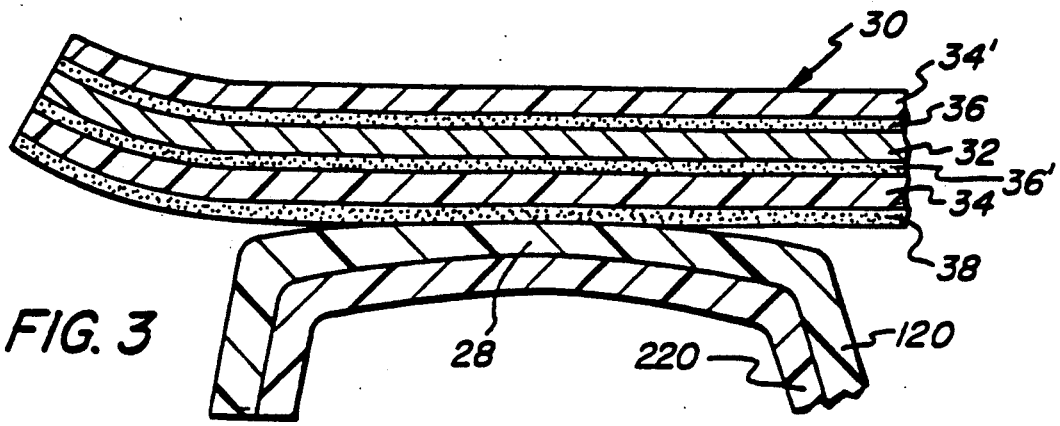
FIG. 3

MICROWAVABLE PACKAGE AND PROCESS

TECHNICAL FIELD

The present invention relates to microwavable packaging which is suitable for protecting foods during handling and storage and which is also suitable for heating for serving with maximum product protection and ease for the consumer.

Microwave cooking is especially advantageous because of its ability to rapidly heat small portions of food. Consumer convenience is important, and simplified instructions can help assure the gustatory satisfaction promised for a well-prepared product. Unfortunately, to date, a number of conflicting safety, packaging, esthetic and convenience priorities and limitations have deterred the development of a shelf-stable, retorted food product which could be simply taken from the grocery shelf and reheated briefly in a microwave oven.

For most microwavable, prepared foods it is necessary to perform one or more success-determinant operations in addition to simply popping the food into the oven—the apparent promise of microwave cooking. Consumers are often disappointed to find, especially when they learn too late, that they must specially program the oven or perform a sequence of distinct heating operations, use a special cooking container or device, remove a packaging lid only to replace it with a cooking lid, vent, interrupt heating, and/or specially orient the package in the oven. Some consumers never determine the cause for failure and never purchase the product again, and some are deterred from purchasing products they perceive to be similar.

There is a present need for a package and method which improves the delivery to the consumer of foods which can be simply, safely, swiftly, and effectively prepared for serving by microwave heating. And, ideally, this package should be retortable to provide a shelf-stable food.

BACKGROUND ART

Many attempts have been made to provide containers for processing and storing foods which permitted heating by microwave and some, also, by conventional ovens. For example, in U.S. Pat. No. 3,865,302, Kane discloses a container consisting of a polyethylene terephthalate tray having a polyethylene terephthalate lid bonded to it with an adhesive blend of an ethylene copolymer and a wax. The tray is formed of a single ply film employing titanium dioxide as an opacifier and talc to enhance the rate of crystallization. The lid, made of a material having properties similar to the tray, is bonded to a flange on the tray by a heat-activated adhesive. The adhesive does not flow or leak even after cooking at temperatures of 400° F. Unfortunately, containers which remain sealed when oven heated to 400° F. develop significant internal steam pressures.

The problem with steam buildup can be especially severe during microwave heating because of the very nature of the heating phenomenon. Microwave heating virtually always causes steam generation from hot spots before the food is heated desirably throughout. The continued generation of steam at these hot spots and the continued heating of the steam itself cause pressures which must be released in a controlled manner. In U.S. Pat. No. 4,210,674, Mitchell proposes applying a small strip of metal to the lid to melt a vent during heating. Similarly, in U.S. Pat. No. 3,997,677 Hirsch and Spiegel disclose a covered tray-like package which includes a weakened seal area to provide pressure relief. Also, several patents have disclosed ovenable polymer-coated paperboard packages which would self vent when heated. For example, in U.S. Pat. No. 3,863,832 Gordon and Siegele disclose that the seal can be made to fail at a preselected temperature where the coating is polyethylene or polypropylene for both tray and lid. Similarly, in U.S. Pat. No. 4,261,504, Cowan discloses a self-venting package having polymer coated paperboard upper and lower portions. One is given a coating of thermoplastic polyester and the other, a thermosetting polyester to provide a package which is said to vent by steam buildup just prior to completion of the cooking cycle.

Another concern, but one which is not addressed by the above patents, is the development of a package which can be used for retorted foods which are able to be stored at room temperature. For example, in U.S. Pat. No. 4,367,312, Bontinck, Jacobs and D'Hondt discuss as important, the ability to form a peelable seal which withstands retort conditions. To achieve a retortable, but peelable seal with packaging films including polyester, polyvinylchloride, polyamide, and polyacrylonitrile, they disclose a blend of an ethylene polymer with polystyrene and other optional components. Additional polymers are disclosed to enhance interpolymer compatibility, fillers can be added for opacity or hardness, and adjuvants and the like can be added for their functions. The heat sealable films are prepared by extrusion followed by corona discharge pretreatment.

The retorting process for non-rigid containers typically entails heating them in water or steam to a predetermined temperature, holding them at that temperature for a time required to thoroughly heat the contents, and then cooling. The pressure inside the containers varies in response to external temperature changes. Unless the proper materials of construction are employed and unless this pressure is compensated for by causing the external pressure to approximate that on the interior, a variety of faults and failures will be produced, among which are: bursting of the packaging material; wrinkles in flexible film portions, especially at corners; partial release of the seal along seams; distortion of printed matter; and other defects.

One commercial packaging system employs three distinct members which cooperate to deliver a room temperature storable, retorted, prepared food product which can be prepared for serving by microwave or conventional oven heating. This package has a shallow dish-like bottom portión, a multi-ply lid heat-sealed to a top flange on the dish, and a vented dome cover which snaps over the top of the dish. To achieve good strength and heat sealability to the lid, the tray is formed of two layers of unpigmented polyethylene terephthalate. The outer layer is partially crystallized to improve toughness and barrier properties while the inner layer is highly amorphous for better heat sealing. The multi-ply lid is a sandwich of polyethylene terephthalate films bonded to an inner aluminum foil core. One side of the lid is coated with an adhesive to provide a peelable seal with the tray flange. In use, the tray is filled with a prepared food, the film is heat-sealed to the tray, and the sealed tray is then heated in a retort as required while applying an external pressure to counterbalance the internal pressure. To prepare the product for use by microwave oven, the heat-sealed lid is removed and discarded and the vented dome cover is snapped onto the tray. In contrast, when the food is prepared for serving by conventional oven heating, the vented dome is discarded and the heat-sealed lid peeled back for a short distance.

The use of both the heat-sealed lid and a separate vented cover is an inefficient use of packaging material, inconvenient, and the possible cause of accidents arising during preparation. Accordingly, while the art has long sought a package which would fulfill the needs for simplicity and effectiveness for foods which were to be capable of final preparation by microwave ovens, it has yet to achieve this. The need is especially acute and unfulfilled for foods which must be retorted to provide room-temperature, shelf stability.

DISCLOSURE OF INVENTION

It is an object of the invention to provide a package for foods which can be prepared for serving by microwave oven heating in a simple and effective operation.

It is another object of the invention to simplify use of a microwavable food package by enabling one step preparation simply heating for the desired time—with the package having a self-venting feature.

It is a further object of the invention to provide a self-venting microwave package which is capable of withstanding retorting.

It is a more detailed object of the invention to provide a self-venting package for storing food at room temperature for extended periods and permit one-step preparation for eating by simply briefly heating in a microwave oven.

It is a further object of the invention to provide processes for packaging and storing and heating foods utilizing a package of the type described.

These and other objects are achieved by the present invention which provides a package and methods for obtaining and utilizing the package which is capable of highly simplified preparation of packaged food products for serving. The package of the invention comprises: a formed lower container portion having a recessed area surrounded by a peripheral sealing rim and a flexible lid heat-sealed to the sealing rim. The container is formed from a multi-, preferably two-, ply laminate of polyethylene terephthalate wherein the outer ply is crystallizable and the inner ply is substantially amorphous. The sealed container is capable of dimensional stability during the retorting necessary to sterilize the contents. The flexible lid is non-extensible under conditions of use, comprises a barrier layer substantially impervious to oxygen and water, and includes a heat-sealable layer which is capable of forming a seal with the substantially amorphous surface of the sealing rim which is both retort stable and self-venting during microwave heating of the package.

The invention further provides the method for packaging a food which comprises: depositing a food product into the recessed area of a multi-ply polyethylene terephthalate container having a sealing rim surrounding the recessed area; sealing a non-extensible, flexible lid to the sealing rim; and retorting the package.

The invention further provides a method utilizing a package of the invention for storing a food product at room temperature for extended times followed by heating for serving, the method comprising: depositing a food product into the recessed area of a multi-ply polyethylene terephthalate container having a sealing rim surrounding the recessed area; sealing a nonextensible lid to the sealing rim; retorting the resulting package; storing the package at room temperature for an extended time; and subjecting the food to microwave energy for a time sufficient to heat the food to a desired serving temperature and to cause the seal between said rim and said lid to partially release and form a vent.

The invention in its various aspects has a number of advantages including true simplicity for the consumer. By virtue of the invention, foods can be stored without refrigeration or freezing, taken directly from the shelf and heated. Thus, there is no need to thaw, and heating time is minimized. There is no need to specially sequence heating in the microwave oven. And, because heating time is so short, there is no need to rotate after partial heating and restart the process. There is no need to remove protective sealing films from the tray and snap on special vented cooking covers. There is no need to specially vent because the package vents automatically during microwave heating.

In addition to these benefits, the invention provides environmental advantages due to efficient overall energy requirements and the beneficial use of recyclable components.

BRIEF DESCRIPTION OF THE DRAWINGS

The present invention will be better understood and its advantages more apparent in view of the following detailed description, especially when read with reference to the accompanying drawings, wherein:

FIG. 1 is a perspective view of a sealed package according to the invention;

FIG. 2 is a cross sectional view taken along line 2—2 in FIG. 1, showing the generation of steam during heating and the self-venting of the heat seal at the container rim; and FIG. 3 shows the detail of an area of the seal between the sealing rim of the container and the flexible lid.

BEST MODE FOR CARRYING OUT THE INVENTION

The invention will be described in conjunction with the drawings to show its advantages with specific reference to preferred materials and parameters. In this regard, reference is made to FIG. 1 which depicts a sealed package 10 of the invention having a lower container portion 20 and a lid 30 sealed to it. Reference to FIGS. 2 and 3 enables viewing the principal components of the package in greater detail.

FIG. 2 shows lower container portion 20 as having a central recessed area 22 which holds a food. The recessed area 22 is defined by upstanding side wall 24 and slightly raised bottom panel 26. Desirably, the side wall 24 flares outwardly from the vertical at an angle of at least 12°, preferably 13° to 25°. Both of these design features are believed to contribute to the dimensional stability of the preferred container, thereby facilitating retorting without damage to the package and self-venting during microwave heating.

A rounded recess 27 between the bottom panel 26 and the side wall 24 extends around the entire container 20. Also, the rim is extended at opposed ends to form handles 29 and 29'. A peripheral sealing rim 28 surrounds the central recessed area 22. Reference to FIG. 3 more clearly shows the preferred embodiment where sealing rim 28 has a slight crown to enhance the reliability of the seal with flexible lid 30.

The container 20 is formed of a multi-ply polymeric stock. As shown in FIG. 3, the container stock comprises an inner ply 120 of a substantially amorphous polyethylene terephthalate and an outer ply 220 of a crystallizable polyethylene terephthalate. The inner ply 120 is sufficiently amorphous to provide effective heat sealing with the flexible lid 30, and the outer ply 220 is sufficiently crystalline to provide barrier properties and the desired dimensional stability during retorting and subsequent oven heating, whether by microwave or conventional oven. After forming and prior to retorting, the inner ply 120 will be less than 10%, and preferably less than 5%, crystalline as formed to assure good heat sealing; and the outer ply 220 will typically be greater than 10% crystalline, typically about 12 to 25%. The average crystallinity of the two layers together at this point will preferably be within the range of from 9 to 19%. To achieve these averages it is preferred to maintain the inner layer as amorphous as possible while permitting the outer layer to achieve a relatively high level of crystallinity.

The multi-ply stock for forming the container is preferably prepared by coextruding two plies of suitable resins as known in the art. The ply which is to form the inner ply 120 will be of sufficient thickness to enable presentation of a uniform sealing surface in the formed container. Typically, the inner ply 120 will comprise from 20 to 40% of the thickness of the multi-ply stock. The outer ply 220 will typically comprise from 60 to 80% of the thickness of the multi-ply stock. The stock is preferably formed into a sheet having a thickness of about 0.04 inch. The exact thickness will of course depend on the specific product application, as well as the size of the final container and the extent to which the stock will be stretched during subsequent forming.

Both plies 120 and 220 are desirably of polyethylene terephthalate and can be of essentially the same starting resin. The inner ply material is desirably virgin resin. In addition to providing good heat sealing qualities, it is an advantage of the invention that the inner ply, which is also the food contacting surface, is virgin polymer with no additives. The outer ply material, on the other hand, can include reworked scrap stock and preferably includes a nucleating agent as well as a stiffening additive which is in the form of a pigment, color at or other additive. Typically, a dry inorganic particulate material such as calcium carbonate, titanium dioxide, or magnesium silicate alone or as a carrier for a color additive, typically organic, is employed as the stiffening additive. In addition to providing a desirable color, stiffening additives such as titanium dioxide increase the density and crystallinity of the outer ply material. This can be important to the provision of dimensional stability in the container during retorting and subsequent heating. While the added dimensional stability during retorting puts added stress on the seal at this point and may be counterindicated for that reason, the increased dimensional stability achieved by virtue of the additive assures self-venting during subsequent microwave heating for preparation of the packaged food product.

The amount of rework which can be tolerated as a component of the resin for the outer, crystallizable ply can be readily determined on a trial and error basis. Typically, as much is employed as is possible while not adversely affecting the functionality of the container.

The stock can be formed into the containers by molding as known in the art. For example, the stock is heated to about 115° to 140° C. and upwardly forced into a vacuum mold assisted by air from a plug which stretches the stock to achieve uniform wall thickness in the finished container. The inner mold surface is heated to about 140° to 170° C. The sealing rim 28 will be thicker than the rest of the container wall and therefore may tend to have a slightly lower crystallinity at the sealing surface.

FIG. 3 shows some detail in the area of the seal between the sealing rim 28 and the flexible lid 30. The flexible lid detail is shown in exaggerated scale for the sake of illustrating a preferred embodiment. The lid 30 is flexible and substantially non-extensible. By non-extensible, we mean that the lid does not significantly increase in dimensions under the stresses to which it is subjected during retorting and microwave heating. For example, preferred materials will require forces in excess of 10, e.g., 12 to 15, pounds per inch to stretch the material 1%. Importantly, the lid should not stretch during retorting to cause cosmetic or seal defects, and it should not stretch during microwave heating so as to relieve the stress on the seal which is necessary to effectively vent the package.

The lid 30 must also provide a barrier to oxygen and moisture. The food is preferably sealed in the package after flushing the container with nitrogen and evacuating to reduce oxygen which can cause deterioration, especially of a room-temperature, shelf-stable product. The barrier is desirably suitable to prevent the permeation of oxygen into the package. Conversely, moisture must be kept in the package to prevent the food from drying out. A preferred barrier will comprise an aluminum foil layer 32. Also preferred are polyethylene terephthalate layers 34 and 34' which are adhered to the foil layer 32 as a sandwich by adhesive layers 36 and 36'.

The composite, multi-ply lid 30 is shown adhered to sealing rim 28 by a heat seal formed between the amorphous polyethylene terephthalate container inner ply 120 and a sealant layer 38 on the lid 30. The sealant is desirably one known in the art to: effectively seal with amorphous polyethylene terephthalate, be resistant to creep during retort, and provide a peel strength which enables relative ease in removal under the conditions of use. Typical of the peel strengths desired after retorting are from about 3 to about 10 pounds per inch at 21° C. One type of sealant suitable for use in the invention, comprises a blend of one or more copolyester resins with inorganic fillers. The sealant can be applied to the lid stock as a suspension of solids in a carrier such as toluene or methyl ethyl ketone. Typically, suspensions comprising from 25 to 40%, e.g., 32%, solids are applied and then heated to dry to a thickness on the order of about 0.7 to 2, e.g., 1.4, pounds per 1000 square feet. Alternatively, the copolyester resin can be coextruded with the polymer for layer 34 to form a two-ply film.

The polyethylene terephthalate layers 34 and 34' can be the same and can be of the same type as employed for the container stock. Desirably, at least one layer, in this case outer layer 34', is biaxially oriented. The adhesive sealing plies 34 and 34' to the foil ply 32 can comprise polyurethane. The thickness of the adhesive layers 36 and 36' will be as needed, typically from 0.7 to 1.8, preferably about 1.3, pounds per 1000 square feet. Where polyurethanes are employed, curing is conducted as needed, e.g., for one week at 55° C.

It is an advantage of the invention that foods can be packaged to protect them during room temperature storage for extended time periods and then simply prepared for serving by placing in a microwave oven for the desired period of time. The package will self-vent as the serving temperature is reached. A food is deposited into the recessed area 22 of the container 20. A lid 30 is then sealed to the sealing rim 28 by the simultaneous application of heat and pressure in the area of the seal.

The sealed package is then subjected to retorting under conditions of heat as necessary to assure room-temperature shelf-stability. Preferably, this is accomplished by heating in water or steam while balancing the pressure outside of the package to approximate that within. Typically, for a single serving of a meal entree, the temperature will be brought up to a suitable level within the range of from about 115° to 140° C., preferably 120° to 130° C., maintained at that temperature, and then cooled. The heating is conducted within a pressure chamber which allows adjusting the pressure in the chamber to balance the pressure within the container. While balance is not typically exactly achieved, the pressures should be close enough to prevent seal creep, partial seal release or stress deformations to either the container 20 or lid 30. Retort times at the target temperature of from 20 to 60 minutes will be typical following a similar time for bringing it up to temperature. A similar cooling period is also typical. After retorting, the crystallinity of the container typically increases to 33 to 52%, as an average of both layers.

The packaged food can be a full-moisture food, e.g., having a normal moisture content of greater than 40% by weight, typically for dishes containing meat, vegetables, or pasta and sauce, from 65 to about 85% by weight. The moisture content and water activity are not important because the package of the invention will protect even higher moisture foods at water activities of 0.85 and above for extended periods of room-temperature storage. Storage for greater than one month is typically required for commercial distribution and minimum stabilities of from three to twelve months are desired. Preferably, shelf-stability for eighteen months is desired. In practical terms, the product should remain stable even beyond these time periods.

To prepare the packaged food for consumption, it is necessary only to heat it in a microwave oven to a desired serving temperature. The package will self-vent. During microwave heating steam pressure is created within the package. This pressure is permitted to build within the package, which has a dimensionally-stable container portion sealed to a non-extensible lid, until it becomes sufficient to rupture the seal, usually at a single location such as 40 in FIG. 2. This typically occurs at a corner of the rim. The remainder of the seal is easy to peel such that the lid is readily separated from the container after the package is removed from the microwave oven. Thus, while the peel strength is from 3 to 10 pounds per inch at room temperature, it will be less than 2 pounds per inch at serving temperature of 140° to 200° F., preferably less than 1.5 pounds at 200° F.

The invention provides a number of advantages. In addition to superior convenience to the consumer, the invention provides high overall energy efficiency and recyclability of the materials employed. The invention eliminates the need for special venting accessories, i.e., a plastic dome, useful only for heating. It eliminates the high energy consumption required for freezing foods, maintaining them frozen, and then thawing. The invention enables preparation from room temperature storage to serving temperature by simply placing the packaged food in a microwave oven. The invention provides long periods of shelf stability during which the food contacts only a virgin resin container surface. The lid does not have to be punctured, partially or totally removed, replaced or otherwise treated. The package is heated intact in a microwave oven. There is no need for special handling of the package prior to heating, special programming of the microwave oven, or special handling subsequent to heating.

As another advantage, handles 29 and 29' may be shielded from microwave energy and remain cooler when a foil is employed in the lid and the lid extends to cover the handles.

The following Example is provided to further illustrate and explain a preferred form of the invention and is not to be taken as limiting in any regard. Unless otherwise indicated, all parts and percentages are by weight.

EXAMPLE

A package as shown in the drawings is prepared from a two-ply container stock and a six-ply lid stock. The oval container portion has a recess with a length at the top of approximately 6.2 inches, a width of about 4.25 inches, and a depth of about 1 inch. The bottom is raised by about 3/32 inch. The angle of the side wall with the vertical is about 15°. A sealing rim (approximately 0.2 inch) surrounds the recess. Handles extend slightly at opposed ends, centered on the long axis.

The two-ply container stock is prepared by coextrusion of crystallizable and amorphous polyethylene terephthalate layers after drying the resin and additives to less than 50 ppm residual moisture. The resin for the amorphous ply is virgin polyethylene terephthalate (I.V. 0.95, number average molecular weight of 32,500, weight average molecular weight of 65,000, and crystalline peak melting point 245° C.). The resin for the crystallizable ply is the same resin but with about 5% of a combination of polypropylene nucleating agent, container stock rework and a colorant comprising a color-coated fine particulate titanium dioxide. The resins are separately fed as melts to a coextrusion die from which they are extruded at about 560° F. and chilled to form a composite sheet with a thickness of about 0.04 inch, with the crystallizable portion being about 0.028 inch and the amorphous portion being about 0.012 inch.

The container stock is positioned with the pigmented, crystallizable ply nearest the interior of a vacuum forming mold, heated to about 125° C., and drawn upwardly into the mold by vacuum with the aid of air flow from a plug assist. The formed sheet is then moved to a cooling mold and rapidly cooled to maintain heat-sealability for the inner ply and inhibit brittleness in the outer ply.

A lid stock is prepared having a 1 mil thick aluminum foil layer sandwiched between two layers of 0.00048 inch thick oriented polyethylene terephthalate film, the layers adhered with a polyurethane adhesive applied at a thickness of 1 pound per 1,000 square feet. One side of this laminate is corona treated, and a heat sealing coating is applied as a suspension to achieve a dry thickness of 1.4 pounds per 1,000 square feet. The lid stock is cured for about seven days at 55° C. The suspension comprises 32% solids (X17-3 available from Morton Chemical, a blend of copolyester resins with inorganic filler) in toluene.

A serving of lasagna with a tomato sauce is deposited in the container recess, the container void space is flushed with nitrogen and then evacuated. The lid stock is heat sealed to the container rim by brief heat and pressure application to the lid stock against the rim. The sealed container is then retorted by raising the temperature over one half hour to 120° C., holding at that temperature for about forty five minutes and then cooling to about 35° C. over about one half hour. During heating and cooling, the sealed package is maintained under water, heated with steam and maintained at an external pressure effective to balance the pressure developed within the package. The peel strength of the lid seal is about 5 pounds per inch.

After cooling and shelf storage, the package is placed in a 500 watt microwave oven and heated for 2 minutes, during which time a portion of the seal is ruptured at one corner. The lid is then easily removed by peeling to provide a meal portion ready for serving.

The above description is for the purpose of enabling the person skilled in the art to make and use the invention and is not intended to describe each and every modification and variation of it which will be obvious to the skilled worker upon reading. All such modifications and variations are intended, however, to be included within the scope of the invention which is defined by the following claims.

What is claimed is:

1. A food package comprising:

a formed container having a recessed area surrounded by a sealing rim, the container being formed from a multi-ply composite of polyethylene terephthalate wherein the outer ply is crystallizable and the inner ply is substantially amorphous, the container being capable of dimensional stability during retorting; and a non-extensible flexible lid comprising a barrier substantially impervious to oxygen and water, and a heat-sealable layer capable of forming a seal with the substantially amorphous polyethylene terephthalate surface of the sealing rim which seal is retort-stable and releases sufficiently during microwave heating to vent the package.

2. A package according to claim 1 wherein the seal between the sealing rim and the flexible lid is within the range of from 3 to 10 pounds per lineal inch at 21° C.

3. A package according to claim 1 wherein the barrier comprises aluminum foil.

4. A package according to claim 3 wherein the barrier comprises a multi-ply laminate having an aluminum foil layer adhesively attached to outer layers of polyethylene terephthalate, at least one of the outer layers being biaxially oriented.

5. A package according to claim 4 wherein the heat-sealable resin comprises at least one copolyester resin and is applied to one of the polyethylene terephthalate plies of the lid in a thickness of from 0.7 to 2 pounds per thousand square feet.

6. A package according to claim 1 wherein the outer ply of the container comprises a stiffening additive which promotes crystallization.

7. A package according to claim 6 wherein said stiffening additive comprises a dry inorganic particulate material selected from the group consisting of calcium carbonate, titanium dioxide, magnesium silicate, and combinations of these.

8. A package according to claim 1 wherein the sealing rim is extended at opposed locations to form handles.

9. A package according to claim 8 wherein the lid comprises an aluminum foil layer which shields the handles from microwave heating.

10. A package according to claim 1 wherein the recess is defined by an upstanding side wall and an elevated bottom panel.

11. A package according to claim 1 wherein the upstanding side wall flares outwardly toward the top and forms an angle of at least 12° with the vertical.

12. A method for packaging a food, comprising:

depositing a food in a formed container having a recessed area surrounded by a sealing rim, the container being formed from a multi-ply composite of polyethylene terephthalate wherein the outer ply is crystallizable and the inner ply is substantially amorphous, the container being capable of dimensional stability during retorting;

sealing to the sealing rim a nonextensible flexible lid comprising a barrier substantially impervious to oxygen and water, and a heat-sealable layer capable of forming a seal with the substantially amorphous polyethylene terephthalate surface of the sealing rim which seal is retort-stable and self vents during microwave heating; and retorting the sealed package.

13. A method according to claim 12 wherein the barrier comprises a multi-ply laminate having an aluminum foil layer adhesively attached to outer layers of polyethylene terephthalate.

14. A method according to claim 13 wherein the seal strength between the sealing rim and the flexible lid is within the range of from 3 to 10 pounds per lineal inch at 21° C., and the heat-sealable layer comprises at least one copolyester resin and is applied to one of the polyethylene terephthalate plies of the lid in a thickness of from 0.7 to 2 pounds per thousand square feet.

15. A method of storing and reheating a food, comprising:

depositing a food in a container having a recessed area surrounded by a sealing rim, the container being formed from a multi-ply composite sheet of polyethylene terephthalate wherein the outer ply is crystallizable and the inner ply is substantially amorphous, the container being capable of dimensional stability during retorting;

sealing to the sealing rim a nonextensible flexible lid comprising a barrier substantially impervious to oxygen and water, and a heat-sealable layer capable of forming a seal with the substantially non-crystalline polyethylene terephthalate surface of the sealing rim which is retort-stable and releases sufficiently during microwave heating to vent the package;

retorting the sealed package; and heating the food in the intact package in a microwave oven.

16. A method according to claim 15 wherein the recess is defined by an upstanding side wall which flares outwardly toward the top and forms an angle of at least 12° with the vertical and an elevated bottom panel.

17. A method according to claim 15 wherein the container, after retorting, has a crystallinity of from 33 to 52% as an average of both layers.

18. A method according to claim 15 wherein the barrier comprises a multi-ply laminate having an aluminum foil layer adhesively attached to outer layers of polyethylene terephthalate.

19. A method according to claim 18 wherein the seal strength between the sealing rim and the flexible lid is within the range of from 3 to 10 pounds per lineal inch at 21° C., and the heat-sealable layer comprises at least one copolyester resin and is applied to one of the polyethylene terephthalate plies of the lid in a thickness of from 1 to 2 pounds per thousand square feet.

20. A method according to claim 18 wherein handles extend at opposed locations from the sealing rim and are shielded from microwave energy during heating.

* * * * *